US006692334B2

(12) United States Patent
Lu

(10) Patent No.: US 6,692,334 B2
(45) Date of Patent: Feb. 17, 2004

(54) STARTER ASSEMBLY FOR AN ENGINE-OPERATED REMOTE-CONTROL TOY CAR

(76) Inventor: Ke-Way Lu, 3F, No. 322, Sec. 6, Min-Chuan E. Rd., Taipei City (JP)

( * ) Notice: Subject to any disclaimer, the term of this patent is extended or adjusted under 35 U.S.C. 154(b) by 37 days.

(21) Appl. No.: 10/177,456

(22) Filed: Jun. 20, 2002

(65) Prior Publication Data

US 2003/0236051 A1 Dec. 25, 2003

(51) Int. Cl.[7] ..... A63H 30/00
(52) U.S. Cl. ..... 446/454; 74/6
(58) Field of Search ..... 74/6, 7 E; 446/454, 446/457, 465

(56) References Cited

U.S. PATENT DOCUMENTS 4,183,341 A * 1/1980 Eastman ..... 123/179 A
4,335,318 A * 6/1982 Mabuchi et al. ..... 290/31
5,095,865 A * 3/1992 Keister ..... 123/179.5

* cited by examiner

*Primary Examiner*—Jacob K. Ackun
*Assistant Examiner*—Jamila Williams
(74) *Attorney, Agent, or Firm*—Ladas & Parry

(57) ABSTRACT

A starter assembly is constructed to include a starter formed of a battery-operated motor and a reduction gear set, a polygonal shaft coupled to the output shaft of the engine of an engine-operated remote-control toy car, an idle gear wheel set coupled to the polygonal shaft, the idle gear wheel set having an active idle gear wheel, and a passive idle gear wheel coupled to the polygonal shaft and meshed with the active idle gear wheel, and a driving rod adapted for connecting the reduction gear set of the starter to the active idle gear wheel of the idle gear wheel set for enabling the starter to start the engine.

3 Claims, 6 Drawing Sheets

STARTER ASSEMBLY FOR AN ENGINE-OPERATED REMOTE-CONTROL TOY CAR

BACKGROUND OF THE INVENTION

1. Field of the Invention

The present invention relates to an engine-operated remote-control toy car and, more particularly, to a starter assembly adapted for starting the engine of an engine-operated remote-control toy car.

2. Description of the Related Art

A drag rope starts the engine of a regular engine-operated remote-control toy car. It is not easy to pull the drag rope to start the engine. When starting the engine, the drag rope may break or injure the operator's hand easily. Further, because an engine hood protects the engine, the operator must detach the engine hood from the engine-operated remote-control toy car before starting the engine, and then reload the engine hood after the engine started. In order to eliminate this complicated engine starting procedure, electric engine starters are developed. An electric engine starter is known comprised of a platform, a motor mounted on the platform, a switch adapted for switching on/off the motor, a reduction gear coupled to the output shaft of the motor, and a jumper cable adapted for connecting to an external battery power source to receive battery power for the motor. When in use, the user must connect the crankshaft of the engine of the toy car to the reduction gear of the electric engine starter, and then connect the jumper cable of the electric engine starter to a battery (for example, the battery of a motor vehicle). When connected, the switch is switched on to start the motor, causing the reduction gear to rotate the crankshaft of the engine. This structure of electric engine starter is heavy and bulky. When wishing to start the engine of the toy car, the user must carry the toy car to the a nearby place around the user's motor vehicle so that the battery of the user's motor vehicle can be connected to the jumper cable to provide the motor with the necessary working voltage.

SUMMARY OF THE INVENTION

The present invention has been accomplished to provide a starter assembly for an engine-operated remote-control toy car, which eliminates the aforesaid drawbacks. It is one object of the present invention to provide a starter assembly for an engine-operated remote-control toy car, which is convenient for carrying by hand. It is another object of the present invention to provide a starter assembly for an engine-operated remote-control toy car, which uses self-provided battery power to start the motor for starting the engine. To achieve these and other objects of the present invention, the starter assembly comprises a starter, the starter comprising a casing, a motor mounted inside the casing, a battery mounted inside the casing and adapted for providing power to the motor, a switch electrically connected between the battery and the motor and adapted for switching on/off the motor, a reduction gear set coupled to the motor, the reduction gear set comprising an output gear, the output gear having a fixed gear shaft and a polygonal coupling hole in one end of the fixed gear shaft; a polygonal shaft coupled to the output shaft of an engine; an idle gear wheel set coupled to the polygonal shaft, the idle gear wheel set comprising an active idle gear wheel and a passive idle gear wheel meshed with the active idle gear wheel, the active idle gear wheel comprising a coupling hole, the passive idle gear wheel comprising a polygonal coupling hole coupled to the polygonal shaft for enabling the polygonal shaft to be synchronously rotated with the passive idle gear wheel to start the engine; and a driving rod adapted for connecting the starter to the idle gear wheel set for enabling the starter to start the engine, the driving rod having a first coupling portion extended from one end thereof and fitted into the polygonal coupling hole of the output gear of the reduction gear set of the starter, and a second coupling portion extended from an opposite end thereof and coupled to the coupling hole of the active idle gear wheel of the idle gear wheel set.

DETAILED DESCRIPTION OF THE PREFERRED EMBODIMENT

Figure 1:
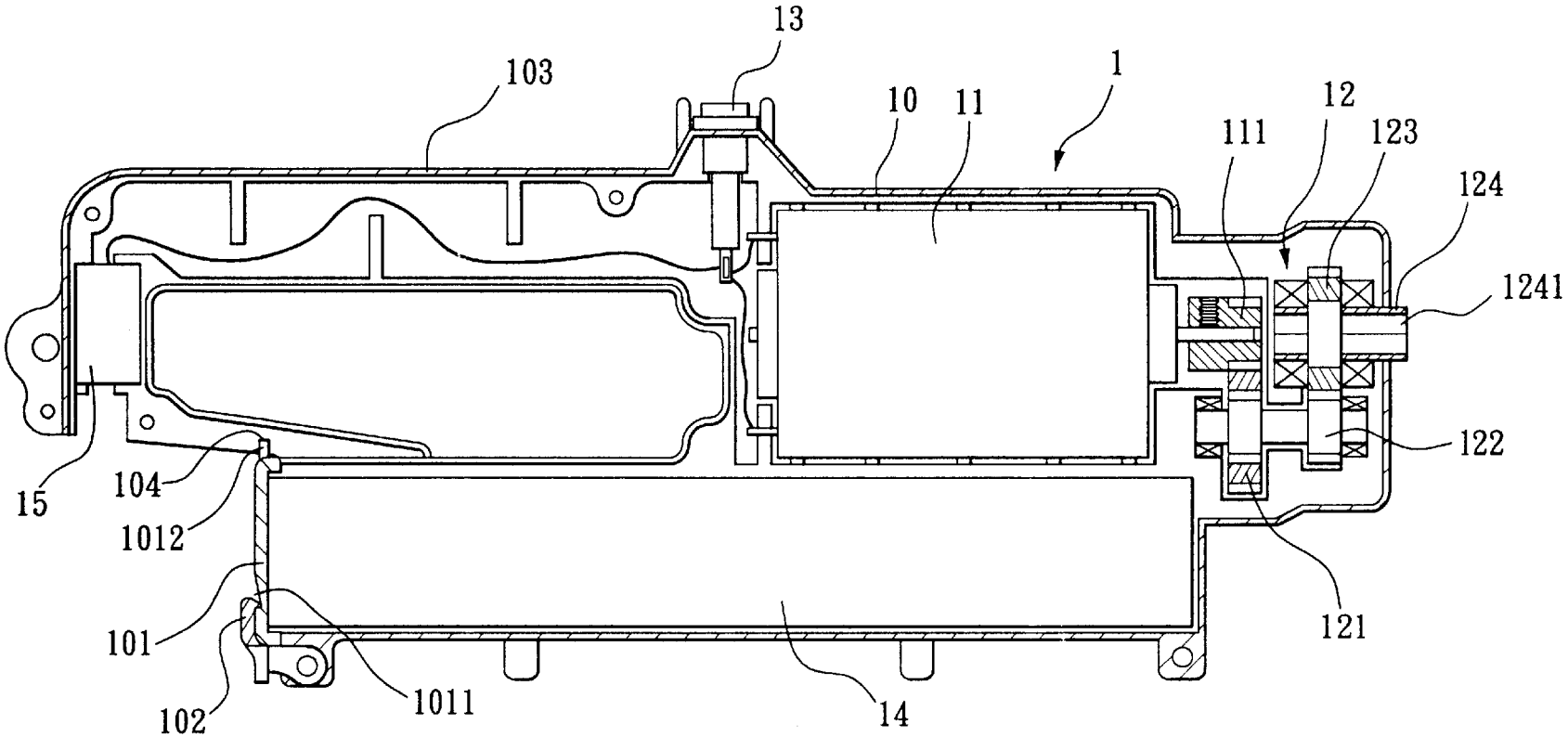
FIG. 1 is a sectional plain view of a starter according to the present invention.
Figure 2:
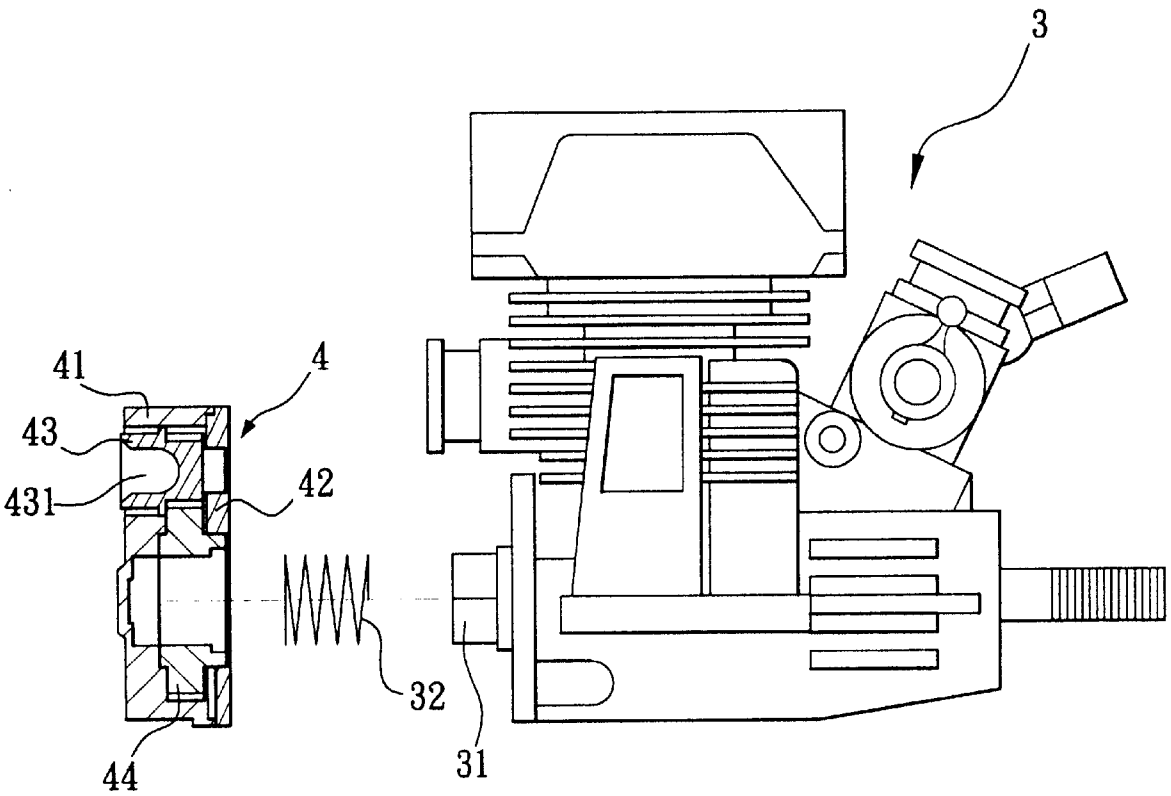
FIG. 2 is an exploded plain view showing the relationship between an idle gear wheel set and an engine according to the present invention.
Figure 3:
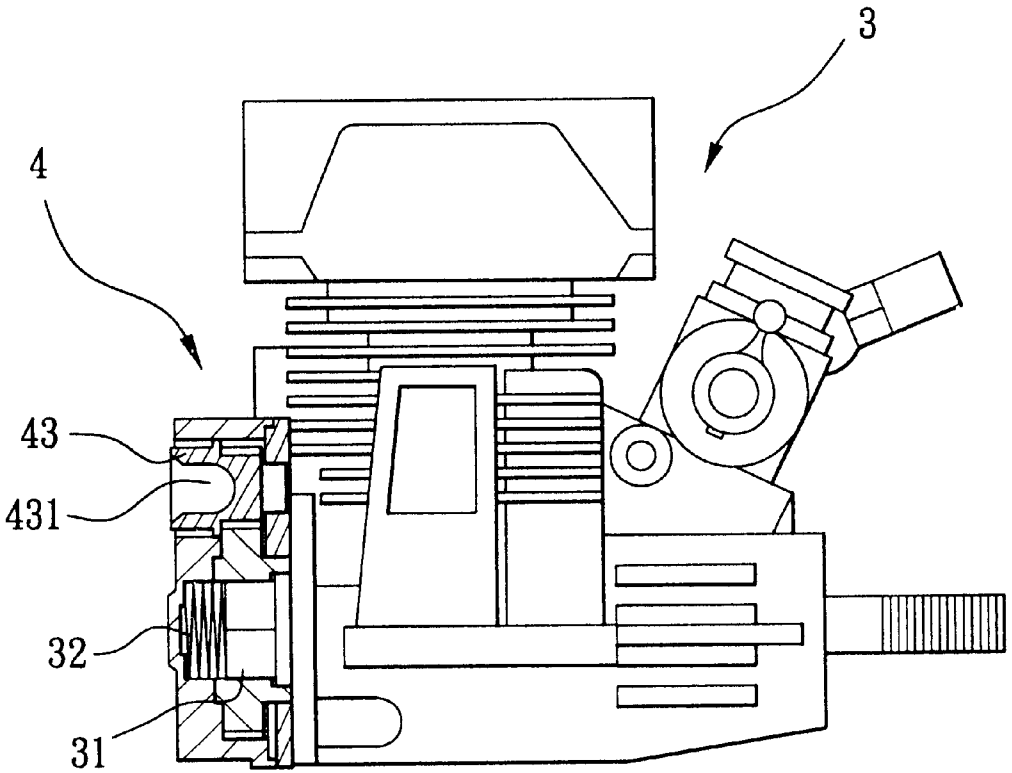
FIG. 3 is an assembly view of FIG. 2.
Figure 4:
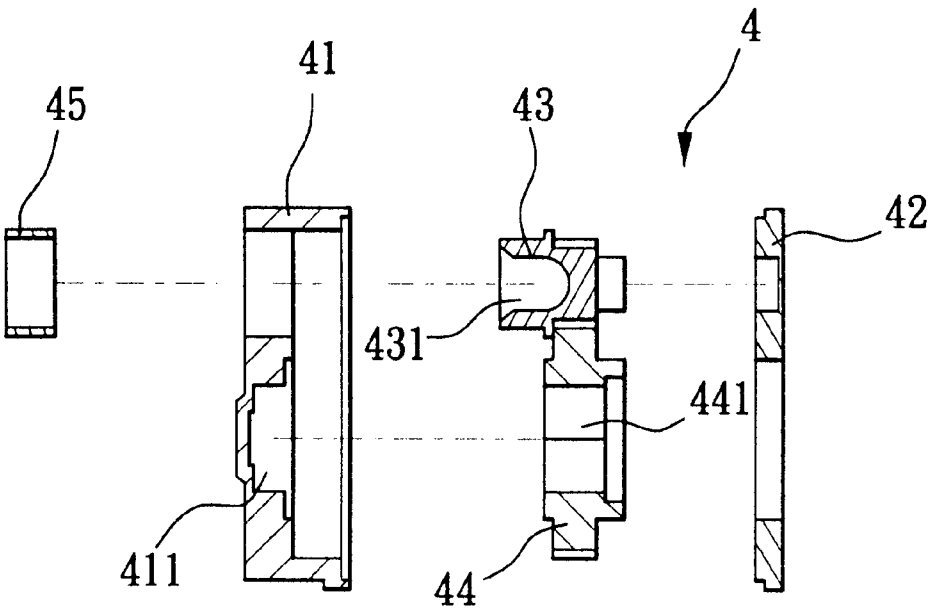
FIG. 4 is an exploded plain view of the idle gear wheel set according to the present invention.

A starter assembly for an engine-operated remote-control toy car in accordance with the present invention is generally comprised of a starter 1 (see FIG. 1), a driving rod 2 (see FIG. 5), and an idle gear wheel set 4 adapted for coupling to the engine 3 (see FIGS. from 2 through 4).

Referring to FIG. 1, the starter 1 comprises a casing 10, the casing 10 having a handle 103 convenient for the gripping of one single hand. The casing 10 has provided therein a motor 11, a battery chamber 14 holding a battery, a switch 13, and a reduction gear set 12. The switch 13 has a part extended to the outside of the casing 10 for operation by the user, and is electrically connected to, the motor 11 and an electric connector 15. A battery lid 101 is detachably fastened to the casing 10 to close the battery chamber 14. The battery lid 101 comprises a protruded portion 1012 in one end, and a recessed portion 1011 in the other end. A locking lever 102 is pivoted to the casing 10 and adapted for locking the battery lid 101. After insertion of the protruded portion 1012 of the battery lid 101 into a plughole 104 in the casing 10, the locking lever 102 is turned to the locking position and engaged into the recessed portion 1011 of the battery lid 101 to lock the battery lid 101. When replacing the battery in the battery chamber 14, the locking lever 102 is turned from the locking position to the unlocking position and disengaged from the recessed portion 1011, for enabling the battery lid 101 to be removed from the casing 10. The aforesaid electric connector 15 is electrically connected to the battery in the battery chamber 14.

The aforesaid reduction gear set 12 comprises a pinion 111 fixedly fastened to the output shaft of the motor 11, a first gear 121 meshed with the pinion 11, a second gear 122 formed integral with the first gear 121, and an output gear 123 meshed with the second gear 122. The output gear 123 has a gear shaft 124. The gear shaft 124 has a polygonal (for example, hexagonal) coupling hole 1241 in one end. When switched on the switch 13 to start the motor 11, the pinion 111 drives the first gear 121 and the second gear 122 to rotate, thereby causing the output gear 123 to be rotated.

Figure 5:
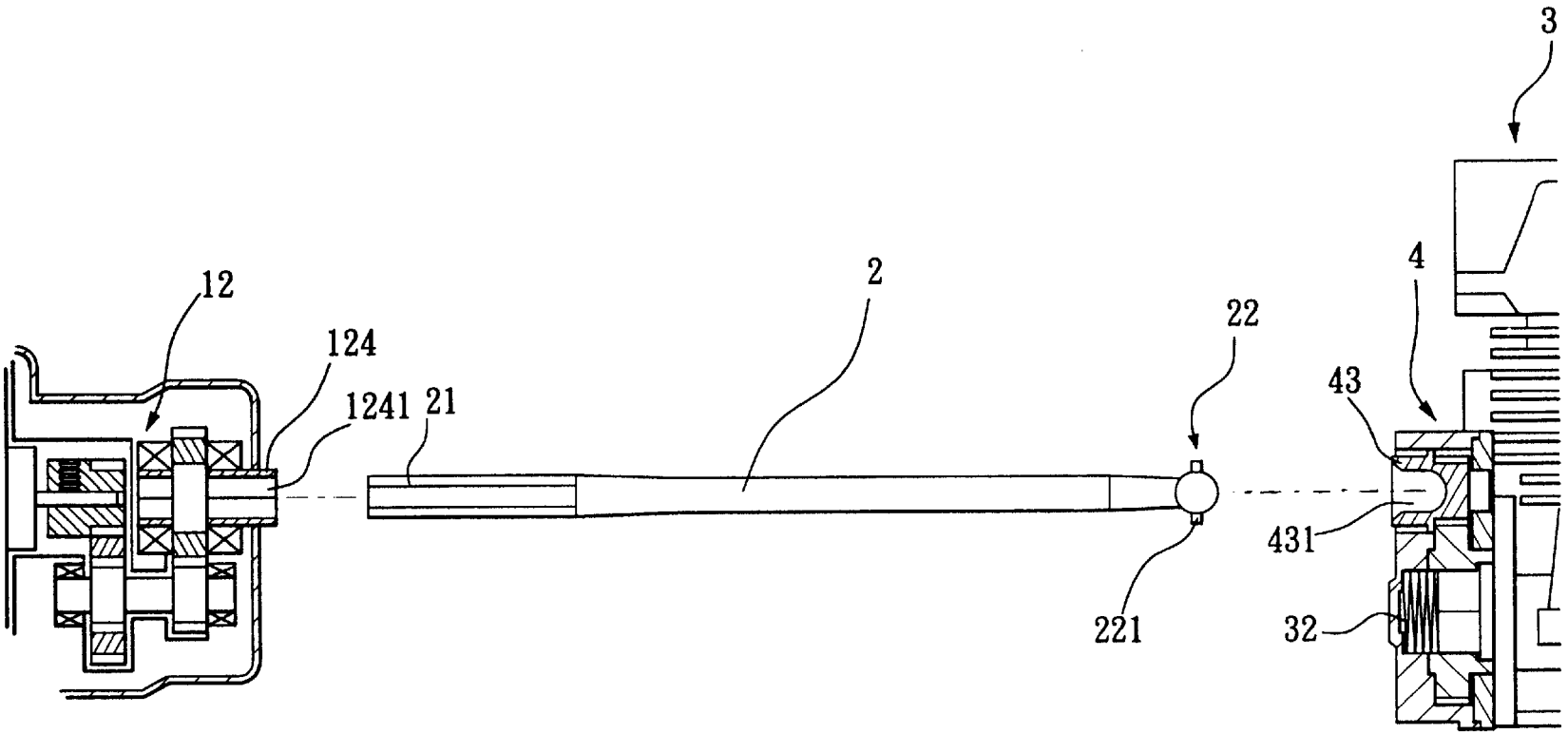
FIG. 5 is an exploded plain view of the starter assembly, showing the relative positioning of the driving rod between the reduction gear set of the starter and the idle gear wheel set at the engine according to the present invention.
Figure 6:
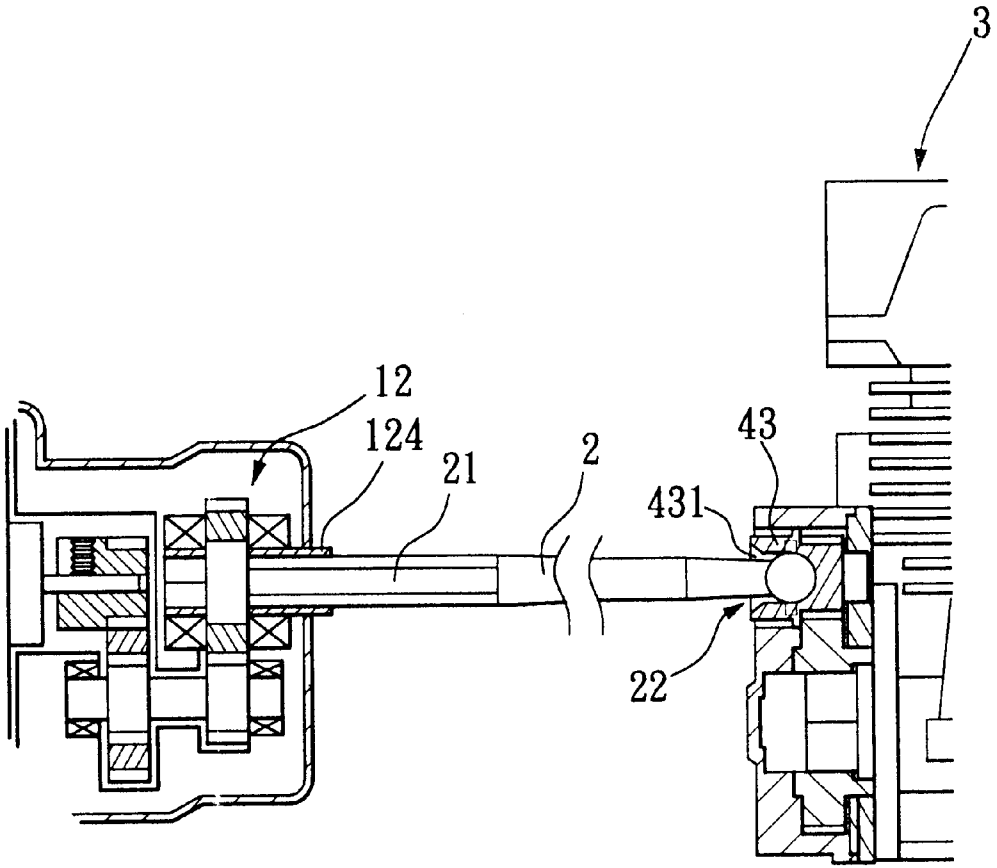
FIG. 6 is an assembly view of FIG. 5.

Referring to FIGS. 5 and 6, the aforesaid driving rod 2 is an elongated rod member having a polygonal coupling portion 21 disposed at one end of fitted into the polygonal coupling hole 1241 of the gear shaft 124 of the reduction gear set 12, a non-spherical connecting portion 22 disposed at the other end, and a pin 221 fixedly fastened to and extended across the non-spherical connecting portion 22.

Referring to FIGS. 2~6, the idle gear wheel set 4 comprises an active idle gear wheel 43, and a passive idle gear wheel 44 meshed with the active idle gear wheel 43. The active idle gear wheel 43 has a coupling hole 431 in one side, which receives the non-spherical connecting portion 22 and pin 221 of the driving rod 2. The passive idle gear wheel 44 has a polygonal coupling hole 441, which receives a polygonal shaft 31, which is connected to the output shaft of the engine 3. The active idle gear wheel 43 and the passive idle gear wheel 44 are meshed together and then mounted in a gear box.41 covered with a cover 42. A bearing 45 is mounted inside the gear box 41 to support the active idle gear wheel 43. The gear box 41 has an inside chamber 411 holding a spring member 32. After the polygonal coupling hole 441 of the passive idle gear wheel 44 has been fastened to the polygonal shaft 31, the polygonal shaft 31 is stopped at the spring member 32. Therefore, the spring member 32 imparts a backward pressure to the polygonal shaft 31, causing the polygonal shaft 31 to be maintained coupled to the output shaft of the engine 3 positively.

When starting the engine 3, the user needs only to couple the non-spherical connecting portion 22 and pin 221 of the driving rod 2 to the coupling hole 431 of the active idle gear wheel 43 and the polygonal coupling hole 1241 of the gear shaft 124 of the reduction gear set 12 to the polygonal coupling portion 21 of the driving rod 2 without opening the engine hood of the engine-operated remote-control toy car. When the driving rod 2 set into position, the switch 13 is switched on to start the motor 11. When the motor 11 started, the gear shaft 124 of the output gear 123 drives the driving rod 2 to rotate the idle gear wheel set 4, thereby causing the passive idle gear wheel 44 to rotate the polygonal shaft 31 and then the engine 3, and therefore the engine 3 is started.

A prototype of starter assembly for an engine-operated remote-control toy car has been constructed with the features of FIGS. 1~6. The starter assembly for an engine-operated remote-control toy car functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A starter assembly for an engine-operated remote-control toy car comprising:

a starter, said starter comprising a casing, a motor mounted inside said casing, a battery mounted inside said casing and adapted for providing power to said motor, a switch electrically connected between said battery and said motor and adapted for switching on/off said motor, a reduction gear set coupled to said motor, said reduction gear set comprising an output gear, said output gear having a fixed gear shaft and a polygonal coupling hole in one end of said fixed gear shaft;

a polygonal shaft coupled to the output shaft of an engine;

an idle gear wheel set coupled to said polygonal shaft, said idle gear wheel set comprising an active idle gear wheel and a passive idle gear wheel meshed with said active idle gear wheel, said active idle gear wheel comprising a coupling hole, said passive idle gear wheel comprising a polygonal coupling hole coupled to said polygonal shaft for enabling said polygonal shaft to be synchronously rotated with said passive idle gear wheel to start said engine; and a driving rod adapted for connecting said starter to said idle gear wheel set for enabling said starter to start said engine, said driving rod having a first coupling portion extended from one end thereof and fitted into the polygonal coupling hole of said output gear of said reduction gear set of said starter, and a second coupling portion extended from an opposite end thereof and coupled to the coupling hole of said active idle gear wheel of said idle gear wheel set.

2. The starter assembly as claimed in claim 1, wherein said casing of said starter has a handle.

3. The starter assembly as claimed in claim 1, wherein said driving rod further comprises a pin fixedly fastened to and extended across said second coupling portion; the coupling hole of said active idle gear wheel fits the second coupling portion and pin of said driving rod.

* * * * *